US006684050B2

(12) United States Patent
Kiuchi

(10) Patent No.: US 6,684,050 B2
(45) **Date of Patent: *Jan. 27, 2004**

(54) METHOD AND APPARATUS FOR IMAGE FORMING CAPABLE OF EFFECTIVELY PERFORMING AN IMAGE FIXING PROCESS

(75) Inventor: Osamu Kiuchi, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/177,279

(22) Filed: Jun. 21, 2002

(65) Prior Publication Data

US 2003/0016974 A1 Jan. 23, 2003

(30) Foreign Application Priority Data

Jun. 21, 2001 (JP) ..... 2001-188059

(51) Int. Cl.[7] ..... G03G 15/20
(52) U.S. Cl. ..... 399/328; 219/216
(58) Field of Search ..... 399/322, 328, 399/329, 370; 219/216; 432/59, 60

(56) References Cited

U.S. PATENT DOCUMENTS 6,269,230 B1 7/2001 Kiuchi
6,542,712 B2 * 4/2003 Kiuchi et al. ..... 399/328

FOREIGN PATENT DOCUMENTS

JP 60-238879 A * 11/1985
JP 8-160795 A * 6/1996
JP 2000-98778 A * 4/2000
JP 2002-82553 A * 3/2002

OTHER PUBLICATIONS

Pending claims and drawings of S.N. 09/989,511 filed Nov. 20, 2001.
Pending claims and drawings of S.N. 09/897,155 file Jun. 29, 2001 and an Amendment filed Aug. 9, 2002.
Pending claims and drawings of S.N. 09/874,990 filed Jun. 7, 2001.
Pending claims and drawings of S.N. 860,595 filed May 21, 2001.
Pending claims and drawings of S.N. 860,594 filed May 21, 2001.

* cited by examiner

*Primary Examiner*—Joan Pendegrass
(74) *Attorney, Agent, or Firm*—Cooper & Dunham LLP

(57) ABSTRACT

An image fixing apparatus includes a fixing roller, a sheet-like-shaped member, a sheet supporter, and a stopper. The fixing roller includes a heater and is rotated to forward a recording sheet having a toner image. The sheet-like-shaped member contacts the fixing roller to form a nip area with the fixing roller. The sheet supporter supports the sheet-like-shaped member at an upstream side of a bottom surface of the sheet-like-shaped member in a sheet transfer direction. The stopper stops a free side of the sheet-like-shaped member so that the free side of the sheet-like-shaped member is not lowered below a predetermined position.

34 Claims, 5 Drawing Sheets

METHOD AND APPARATUS FOR IMAGE FORMING CAPABLE OF EFFECTIVELY PERFORMING AN IMAGE FIXING PROCESS

BACKGROUND

1. Field

This patent specification relates to a method and apparatus for image forming, and more particularly to a method and apparatus for image forming that is capable of effectively performing an image fixing process using a sheet-like-shaped member for forming a heat and pressure nip.

2. Discussion of the Background

FIG. 1 illustrates a typical structure of a background fixing apparatus that is employed in an electrophotographic image forming apparatus to fix a toner image on a recording sheet. As shown in FIG. 1, the background fixing apparatus includes a heat fixing roller 1 which is provided with a heater 2 arranged inside for heating and a pressure fixing roller 3 arranged in pressure contact with the heat fixing roller 1. The fixing apparatus further includes a temperature detector 4 for detecting a surface temperature of the heat fixing roller 1 heated by the heater 2, a guide plate 5 for guiding a recording sheet into an area between the heat fixing roller 1 and the pressure fixing roller 3, a separation pawl 6 for separating the recording sheet wrapping around the heat fixing roller 1 from the heat fixing roller 1, and a pair of transfer rollers 7 arranged in a sheet exit side of the fixing apparatus.

Into this fixing apparatus, a recording sheet having a toner image thereon is transferred and is guided by the guide plate 5 to a nip area formed between the heat fixing roller 1 and the pressure fixing roller 3. The toner image on the recording sheet is subjected to heat and pressure in the nip area and is fixed on the recording sheet. After that, the recording sheet having the fixed toner image thereon is transferred and is ejected outside the fixing apparatus with the pair of transfer rollers 7. As the recording sheet passes through the nip area, toner particles attached to heat fixing roller 1 are removed by a cleaning pad (not shown).

The surface temperature of the heat fixing roller 1 is detected by the temperature detector 4 and, based on the detection result by the temperature detector 4, a heat controller (not shown) controls the heating of the surface temperature of the heat fixing roller 1 with the heater 2.

Conventionally, the background fixing apparatus employing a pair of the above-described heat fixing roller 1 and the pressure fixing roller 3 generally adopts an infrared heater or a halogen heater as a heating element. However, the pressure fixing roller 3 has a relatively large heat capacity due to its structure that typically uses a core metal covered with a silicone rubber layer on which a release layer made of polytetrafluoroetylene (e.g., TEFLON) is formed. Because of this large heat capacity, the pressure fixing roller 3 takes a relatively long time to heat, after the heating of the heat fixing roller 1 with the heater 2 is started. This tendency grows with a control developed in recent years with consideration given to energy savings and becomes a major factor causing a failure of the fixing process. Further, this background fixing apparatus has another drawback that the components involved are relatively expensive.

In addition, the background fixing apparatus presses the heater fixing roller 1 against the pressure fixing roller 3 with a relatively large force in order to maintain a predetermined width of the nip area, and such large force produces a stress relative to the recording sheet transferred by the heater fixing roller 1 and the pressure fixing roller 3. As a result, the recording sheet may form wrinkles therein. These wrinkles are referred to as a fixing wrinkles.

To attempt to avoid the fixing wrinkles, a fixing apparatus is developed which employs a pressure member having a sheet-like shape in place of the pressure fixing roller 3 and contacts such pressure member with the heat fixing roller 1 so as to form a nip area between the pressure member and the heat fixing roller 1. In this configuration, the pressure member is prone to be quickly heated due to the sheet-like shape thereof. Also, the nip area is given a predetermined width without causing fixing wrinkles in the recording sheet.

However, the above-mentioned fixing apparatus using the pressure member in the sheet-like shape has a drawback that the nip width is varied and accordingly types of available recording sheets may be limited. That is, in order to arrange the pressure member to press the heat fixing roller, a spring or the like may be disposed at a position opposite to the heat fixing roller relative to the pressure member to press the pressure member against the heat fixing roller. Under such a circumstance, the pressure member may be moved slightly in accordance with the thickness of the recording sheet and, as a result, the nip width may be varied.

SUMMARY

This patent specification describes a novel image fixing apparatus that uses a sheet-like-shaped member. In one example, a novel image fixing apparatus includes a fixing roller, a sheet-like-shaped member, a sheet supporter, and a stopper. The fixing roller includes a heater and is configured to rotate to forward a recording sheet having a toner image. The sheet-like-shaped member is configured to contact the fixing roller to form a nip area with the fixing roller. The sheet supporter is configured to support the sheet-like-shaped member at an upstream side of a bottom surface of the sheet-like-shaped member in a direction in which the recording sheet is transferred. The stopper is configured to stop a free side of the sheet-like-shaped member so that the free side of the sheet-like-shaped member is not lowered from a predetermined position.

The stopper may be configured to be movable, and the image fixing apparatus may further include an adjustment mechanism which is configured to move the stopper to adjust a vertical position of the sheet-like-shaped member.

The stopper may be configured to be an eccentric roller having an eccentric shaft and the adjustment mechanism including a shaft supporter for supporting the eccentric shaft and an adjuster for turning the eccentric shaft.

The eccentric shaft may be configured to have a cross section of a polygonal and the shaft supporter may be configured to have a V-like-shaped portion to be engaged with a corner of the polygon of the eccentric shaft.

The adjuster may be connected to the eccentric shaft and may be configured to have indexes for indicating information associated with turning positions of the eccentric shaft corresponding to vertical positions of the sheet-like-shaped member.

The information indicated by the indexes may include applicable thickness of a recording sheet corresponding to the vertical positions of the sheet-like-shaped member.

The novel image fixing apparatus may further include a moving mechanism configured to move the fixing roller to make contact with the sheet-like-shaped member.

The moving mechanism may include a holding member configured to hold the fixing roller for rotation and a pressing member configured to apply a force to the holding member in a direction toward the sheet-like-shaped member.

The holding member may be provided with a turning shaft at a position different from a rotation axis of the fixing roller so that the holding member is caused to pivot about the turning shaft by the force of the pressing member to make contact with the sheet-like-shaped member.

The moving mechanism may further include an actuating lever configured to switch to a first position to hold the holding member against the force of the pressing member such that the fixing roller is separated from the sheet-like-shaped member and to a second position to release the holding member so that the fixing roller is made in contact with the sheet-like-shaped member, and a stopper provided to the holding member for stopping the actuating lever at the first position.

The sheet-like-shaped member may be made of a rigid and heat-resistant resin.

This patent specification further describes another novel image fixing apparatus. In one example, this novel fixing apparatus includes a plurality of rollers, a sheet-like-shaped member, a holder, and a stopper. The plurality of rollers includes at least one fixing roller containing a heating source. The sheet-like-shaped member contacts the fixing roller, forms a nip area therewith, and is made of a rigid and heat-resistant resin. The holder is configured to hold one side of the sheet-like-shaped member. The stopper is configured to stop a free side of the sheet-like-shaped member such that the free side of the sheet-like-shaped member is not lowered below a predetermined position.

This patent specification further describes a novel method of image forming. In one example, the novel method includes the steps of providing, arranging, supporting, applying, stopping, and transferring. The providing step provides a fixing roller that includes a heater and is rotated to be able to forward a recording sheet having a toner image in a sheet transfer direction. The arranging step arranges a sheet-like-shaped member made of a rigid and heat-resistant material under the fixing roller. The supporting step supports the sheet-like-shaped member at an upstream side of a bottom surface of the sheet-like-shaped member in the sheet transfer direction. The applying step applies a pressure to the fixing roller so that the fixing roller is made to contact under pressure with the sheet-like-shaped member so as to form a nip area therebetween. The stopping step stops a free side of the sheet-like-shaped member so that the free side of the sheet-like-shaped member is not lowered from a predetermined position. The transferring step transfers a recording sheet having a toner image thereon into the nip area in the sheet transfer direction.

This patent specification further describes a novel image forming apparatus. In one example, the novel image forming apparatus includes an image fixing apparatus including a fixing roller, a sheet-like-shaped member, a sheet supporter, and a stopper. The fixing roller includes a heater and is configured to rotate to forward a recording sheet having a toner image. The sheet-like-shaped member is configured to contact the fixing roller to form a nip area with the fixing roller. The sheet supporter is configured to support the sheet-like-shaped member at an upstream side of a bottom surface of the sheet-like-shaped member in a direction in which the recording sheet is transferred. The stopper is configured to stop a free side of the sheet-like-shaped member so that the free side of the sheet-like-shaped member is not lowered from a predetermined position.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
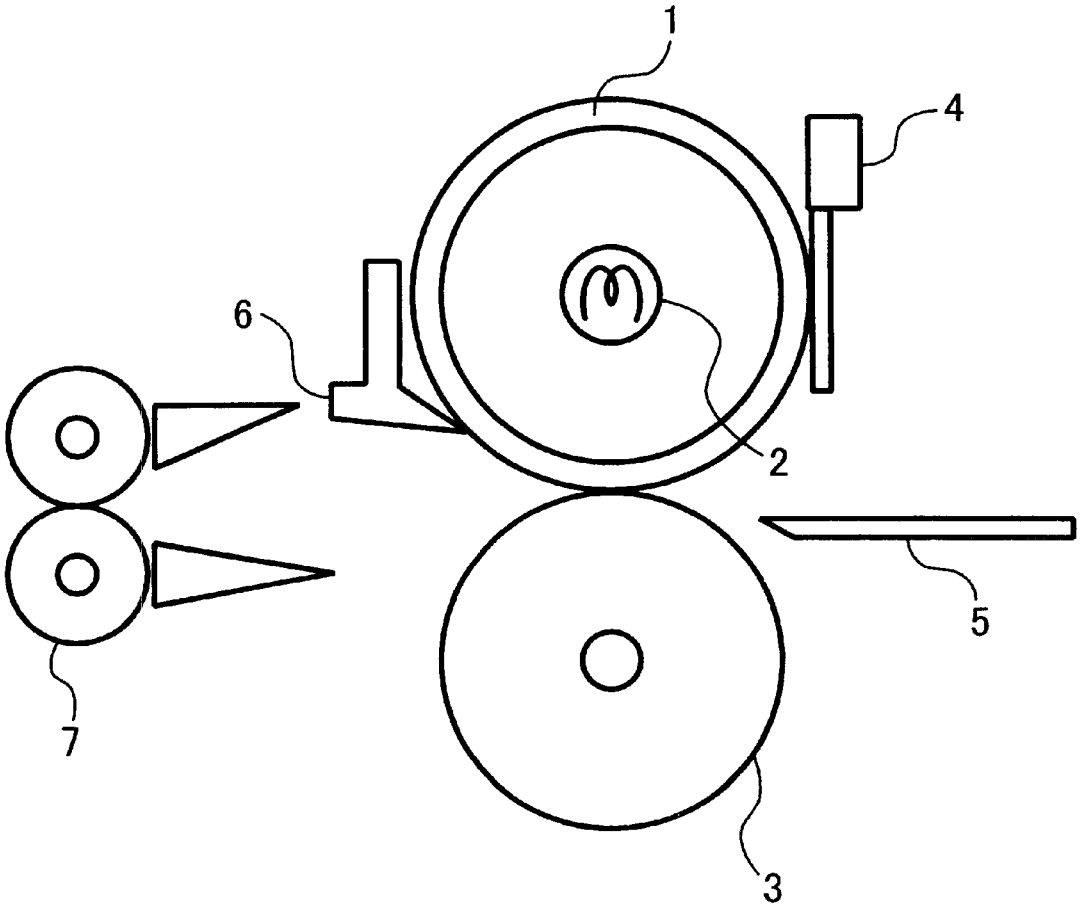
FIG. 1 BACKGROUND ART
FIG. 1 is a schematic illustration for explaining a structure of a background image fixing apparatus.
Figure 2:
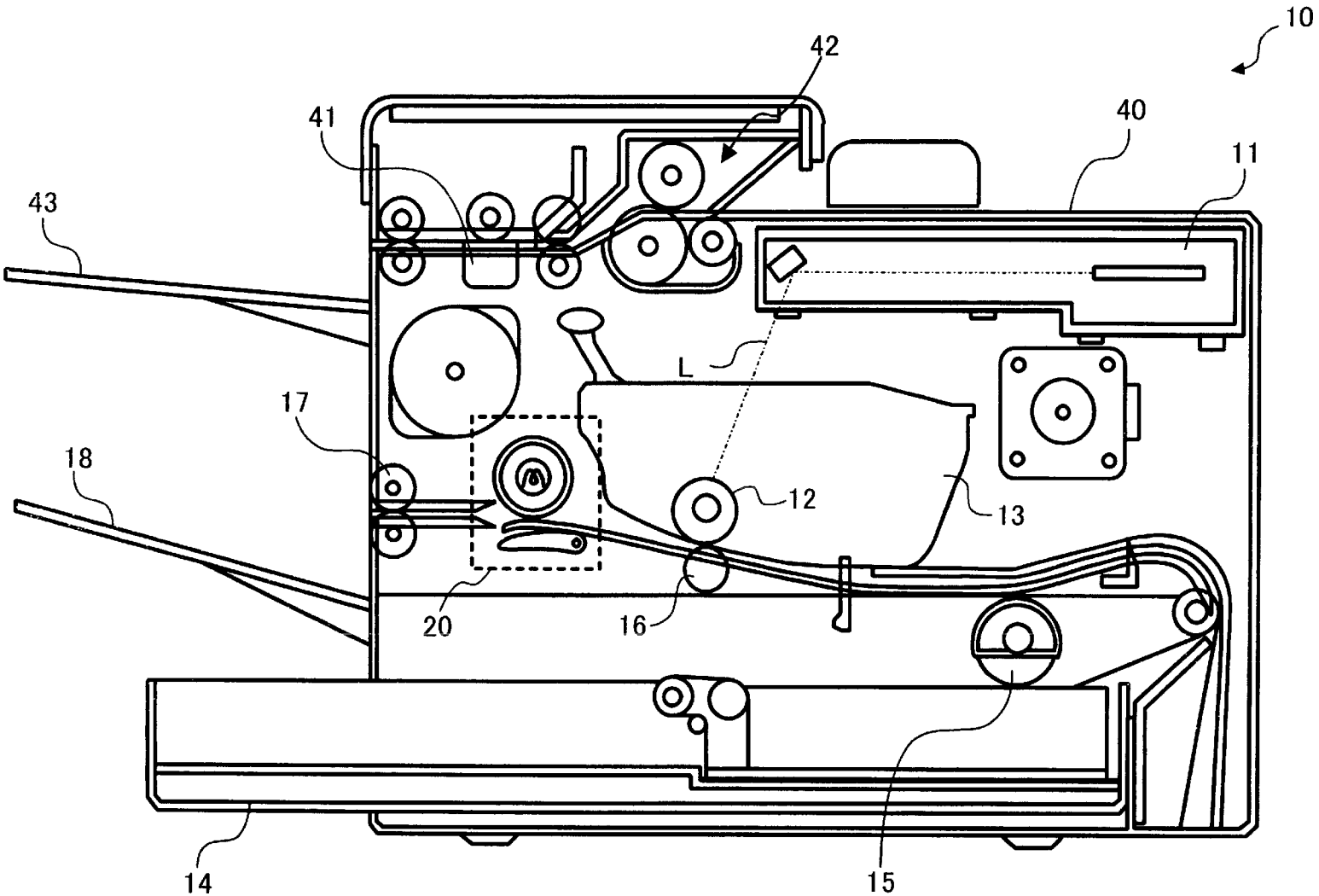
FIG. 2 is a side cross-sectional view of an image forming apparatus according to a preferred embodiment.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 2, a description is made of a facsimile apparatus 10 as one example of an electrophotographic image forming apparatus according to a preferred embodiment. FIG. 2 is a cross-sectional schematic view of the facsimile apparatus 10. As shown in FIG. 2, the facsimile apparatus 10 includes an optical writing unit 11, a photosensitive member 12, a process cartridge 13, a sheet cassette 14, a feed roller 15, an image transfer roller 16, a pair of sheet transfer rollers 17, a sheet ejection tray 18, and a fixing unit 20. The facsimile apparatus 10 further includes a document bed 40, a close-contact sensor 41, a document feed mechanism 42, and a document output tray 43.

The optical writing unit 11 produces a laser light beam L modulated in accordance with image data and causes the laser light beam L to scan the photosensitive member 12 so as to form a latent image thereon. The process cartridge 13 accommodates the photosensitive member 12 as well as various components associated with the electrophotographic image processing, and is configured to be detachable from the facsimile apparatus 10. The sheet cassette 14 contains recording sheets which are picked up and fed sheet by sheet by the feed roller 15. A toner image on the photosensitive member 12 based on the latent image is transferred onto the recording sheet by the image transfer roller 16 which contacts the photosensitive member 12. The recording sheet having the toner image thereon is fed to the fixing unit 20 which fixes the toner image on the recording sheet, and the sheet is ejected to the sheet ejection tray 18 by the pair of sheet transfer rollers 17.

An original document placed on a document bed 40 is brought to pass by the close-contact sensor 41 and is ejected to the document output tray 43, by the document feed mechanism 42. During the time the original document passes by the close-contact sensor 41, an image of the original document is optically read by the close-contact sensor 41. The image data read by the close-contact sensor 41 can be treated as a facsimile signal and transmitted to other facsimile machines or the like through a facsimile communications procedure. Alternatively, or in addition, the image data read by the close-contact sensor 41 in the way described above or input from other facsimile machines into the facsimile apparatus 10 is handled as input image data and is sent to the optical writing unit 11.

The optical writing unit 11 generates the laser light beam L through modulation in accordance with the input image data and causes the laser light beam L to scan the surface of the photosensitive member 12, thereby forming an electrostatic latent image on the surface of the photosensitive member 12. The electrostatic latent image is developed into a visual image with toner particles on the photosensitive member 12. Such visual image is referred to as a toner image. Then, the toner image formed on the photosensitive member is transferred onto a recording sheet by the image transfer roller 16. After a completion of the image transfer, the recording sheet having the toner image thereon is moved to the fixing unit 20 which applies heat and pressure to the toner image which is unfixed up to this time. With such heat and pressure, the toner image is fixed on the recording sheet. Then, the recording sheet is ejected to the sheet ejection tray 18 by the pairs of sheet transfer rollers 17.

Figure 3A:
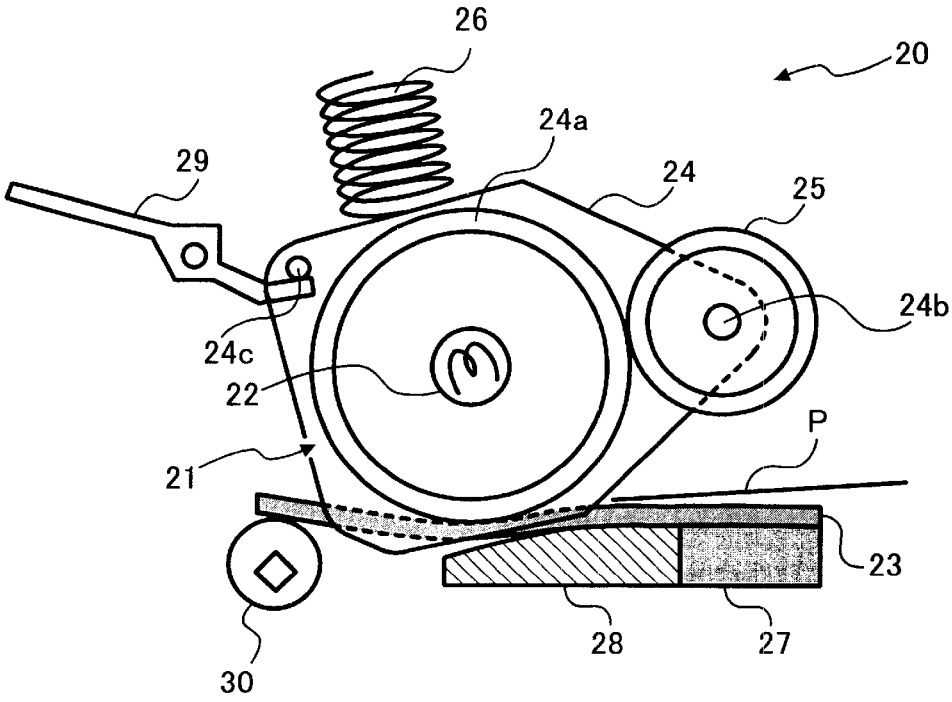
FIG. 3A is a side cross-sectional view of a fixing unit included in the image forming apparatus of FIG. 2, in a state in which a fixing roller contacts with a sheet-like-shaped member to form a nip area therebetween.
Figure 3B:
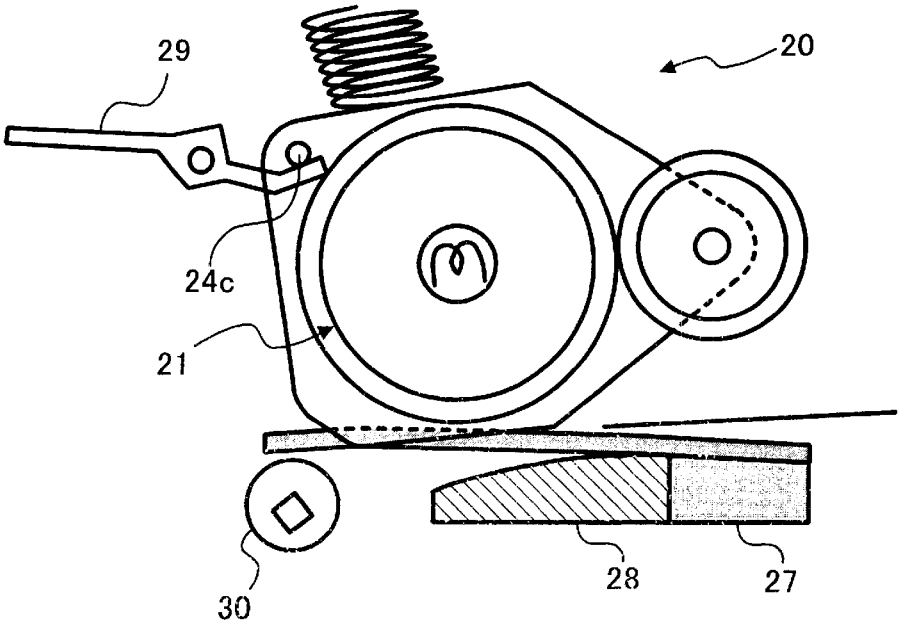
FIG. 3B is a side cross-sectional view of the fixing unit in a state in which the fixing roller is separated from the sheet-like-shaped member.

Referring to FIGS. 3A and 3B, an exemplary structure and operations of the fixing unit 20 are explained in detail. As shown in FIG. 3A, the fixing unit 20 includes a fixing roller 21, a heater 22, a sheet-like-shaped member 23, a housing 24, a transmission gear 25, a pressure member (e.g., a spring) 26, a sheet supporter 27, a first stopper 28, an actuator (e.g. a lever) 29, and a second stopper 30. The housing 24 includes a supporter 24*a* for supporting the fixing roller 21, a pivot shaft 24*b* for allowing the housing 24 to pivot about the pivot shaft 24*b*, and a pawl 24*c*. The transmission gear 25 transmits a driving force generated by a driving power generator (not shown) to the fixing roller 21. The pressure member 26 presses the fixing roller 21 against the sheet-like-shaped member 23. The sheet supporter 27 supports the sheet-like-shaped member 23. The first stopper 28 stops or limits bending of the sheet-like-shaped member 23.

The actuator 29 allows the fixing roller 21 to move between first and second positions, up and down, about pivot 24*b*. In the first position, the fixing roller 21 contacts the sheet-like-shaped member 23 and a nip area is formed therebetween, as illustrated in FIG. 3A. In the second position, the fixing roller 21 is separated from the sheet-like-shaped member 23 and no nip area is formed therebetween, as illustrated in FIG. 3B. The actuator 29 has one end engaged with the pawl 24*c* of the housing 24 and another end connected to a driving mechanism (not shown) for driving the actuator 29 to move the fixing roller 21 between the first and second positions, as described above. When the actuator 29 is moved to release the housing 24, the housing is moved by the pressure member 26 and is stopped in the first position with a third stopper (not shown) such that the fixing roller 21 is brought to push the sheet-like-shaped member 23 with a pressure of from 1N to 20N at the nip area.

The second stopper 30 is arranged at a position downstream from the nip area in the direction in which a recording sheet P is transferred and under the sheet-like-shaped member 23. When the fixing roller 21 is moved from the second position to the first position, the side of the sheet-like-shaped member 23 close to the second stopper 30 is pressed down by the fixing roller 21 and is brought into contact with the second stopper 30, as illustrated in FIG. 3A. That is, the position of the side of the sheet-like-shaped member 23 at to the second stopper 30 is regulated by the second stopper 30.

The sheet-like-shaped member 23 may be made of any one of a heat-resistant resin including a rigid fluoride resin or polyimide, a heat-resistant or rigid substrate covered with a fluoride resin, a substrate attached by a metal plate, and a metal plate made of a rigid iron, copper, or the like. The above-mentioned substrate may include air bubbles, with consideration given to a thermal storage capability of the substrate.

Further, it is also possible to form the sheet-like-shaped member 23 using a common material used for the cases, for example, of the fixing unit, such as a polycarbonate resin, an ABS (acrylonitrile-butadiene-styrene) resin, or the like, having a sufficient heat-resistant nature. Also, it is possible to form the sheet-like-shaped member 23 integrated with the sheet supporter 27 into a single component. By these arrangements, the number of components can be reduced.

The recording sheet P carrying the transferred toner image is forwarded to the fixing unit 20 in which, by this time, the fixing roller 21 is heated up to a predetermined fixing temperature by the heater 22 and is moved to the first position by the actuator 29 to make contact with the sheet-like-shaped member 23. Also, the fixing roller 21 is driven to rotate to forward the recording sheet P. Under such conditions of the fixing unit 20, the recording sheet P is subjected to the fixing process with heat and pressure in the nip area between the fixing roller 21 and the sheet-like-shaped member 23.

Figure 4:
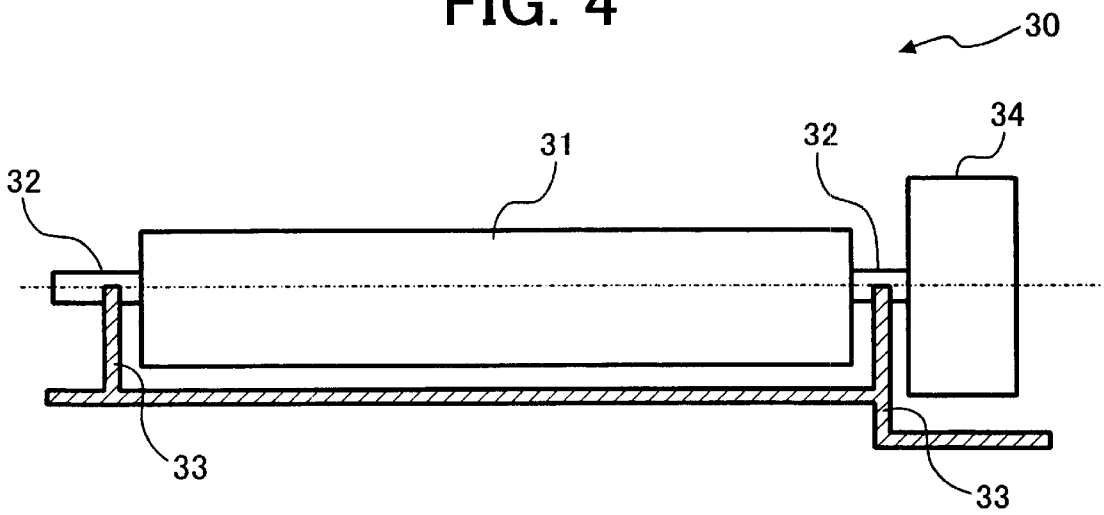
FIG. 4 is a front cross-sectional view of a stopper stopping the sheet-like-shaped member.

FIG. 4 is a front view of the second stopper 30 of the fixing unit 20. The second stopper 30 includes an eccentric roller 31 which has a rotary shaft 32 at a position eccentric relative to the center axis of the eccentric roller 31. The rotary shaft 32 has a square cross-sectional profile and is arranged at a position such that one of two diagonal lines in the square of the cross section intersects the center axis of the eccentric roller 31. The second stopper 30 further includes shaft supporters 33 which are arranged at positions under both edge sides of a movable side of the sheet-like-shaped member 23. Each of the shaft supporters 33 has a portion of a 90-degree V-like shape for carrying and supporting the rotary shaft 32.

When the eccentric roller 31 is installed with the rotary shaft 32 fitting on the shaft supporters 33, the movable side of the sheet-like-shaped member 23 contacts with the eccentric roller 31.

The second stopper 30 further includes a control knob 34 which is provided at one end of the rotary shaft 32 of the eccentric roller 31 and which uses the rotary shaft 32 as the center axis thereof. This control knob is manipulated by an operator.

Figure 5:
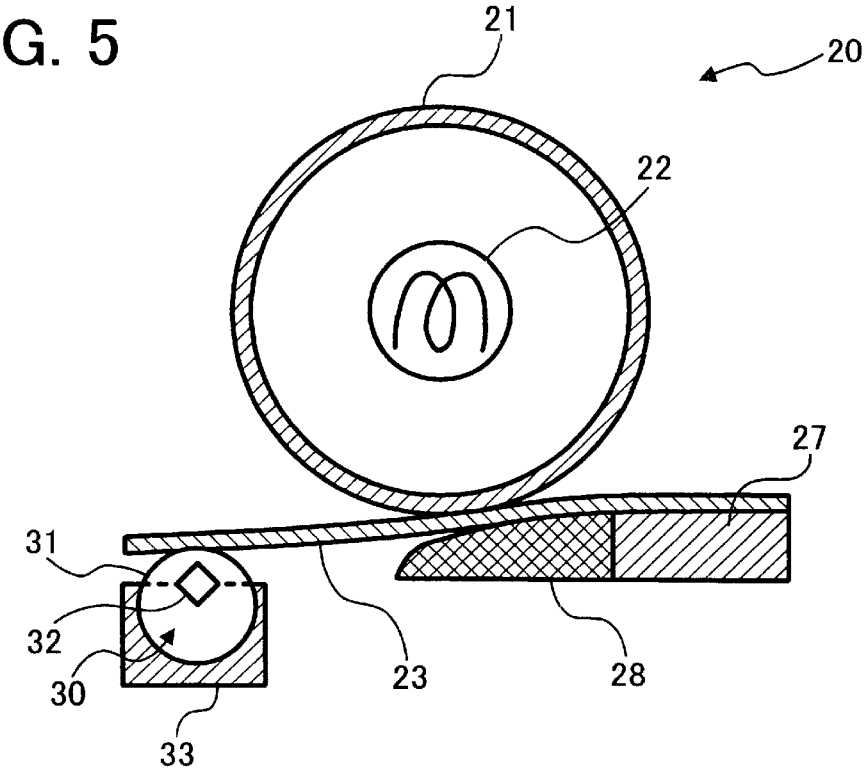
FIG. 5 is another side cross-sectional view of the fixing unit in which the sheet-like-shaped member is settled at the lowest position.
Figure 6:
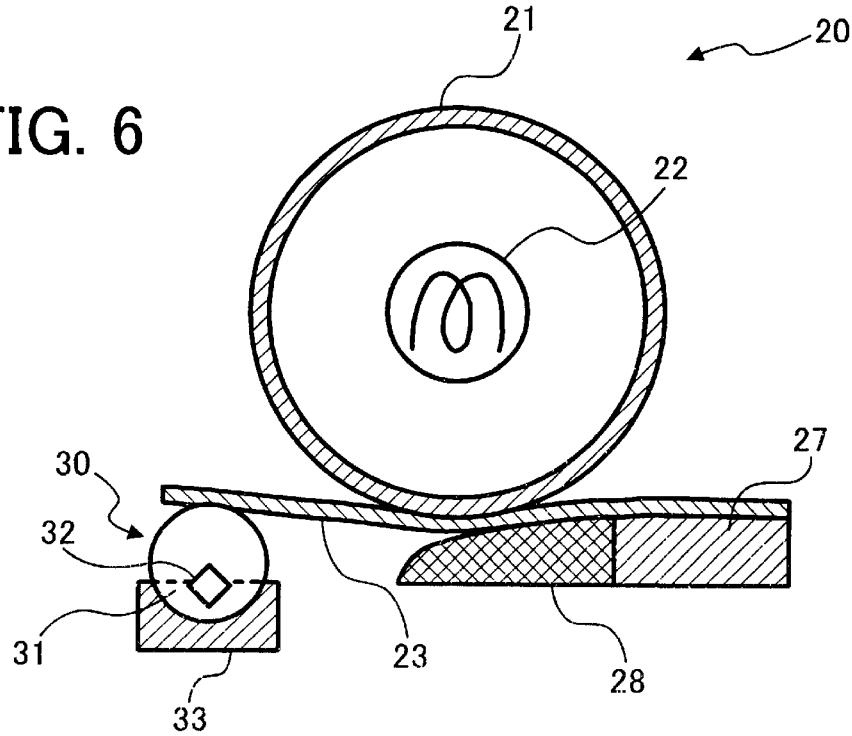
FIG. 6 is another side cross-sectional view of the fixing unit in which the sheet-like-shaped member is settled at the highest position.

When the eccentric roller 31 is in a position such that a corner of the cross sectional square of the rotary shaft 32 closest to the center axis of the eccentric roller 31 is supported by the shaft supporters 33, the sheet-like-shaped member 23 is brought to a position closest to the rotary shaft 32, as illustrated in FIG. 5. The control knob 34 can be rotated by 90 degrees and the next corner of the cross sectional square of the rotary shaft 32 is stopped with a click by an engagement with the shaft supporters 33. During this 90-degree rotation, the eccentric roller 31 lifts the sheet-like-shaped member 23 and, as a result, the width of the nip area between the fixing roller 21 and the sheet-like-shaped member 23 is increased. When the control knob 34 is further rotated by 90 degrees and the next corner of the cross sectional square of the rotary shaft 32 is engaged with the shaft supporters 33, the sheet-like-shaped member 23 is brought to a position most distant from the rotary shaft 32, as illustrated in FIG. 6. Thus, the nip area has the maximum width. In this way, the width of the nip area can be controlled by the control knob 34.

Indications for selective sheet types, environmental conditions, and the like are provided to the control knob 34 so that by turning the control knob 34 the operator can change the engagement of the shaft supporters 33 with one of the four corners of the cross-sectional square of the rotary shaft 32 suitable for the sheet type or environmental conditions desired, for example. In the present embodiment, the control knob 34 is provided with three indicators "THICK" for a thick sheet, "NORMAL" for a normal sheet, and "THIN" for a thin sheet. When the operator turns the control knob 34 to select "THICK" to use a thick sheet, the sheet-like-shaped member 23 is moved down to the lowest position. Likewise, when the control knob 34 is turned to select "NORMAL," the sheet-like-shaped member 23 is moved to the middle position and when the control knob 34 is turned to select "THIN," the sheet-like-shaped member 23 is moved to the highest position.

With the above-described structure, the eccentric roller 31 contacts the free edge side of the sheet-like-shaped member 23 and consequently functions as a stopper for stopping or limiting downward motion of the sheet-like-shaped member 23. That is, the eccentric roller 31 regulates the vertical movement of the sheet-like-shaped member 23, particularly when the recording sheet is brought to pass through the nip area, so as to stably hold the nip width. Further, the operator can adjust the nip width according to the type of the sheet by turning the control knob 34, that is, the eccentric roller 31 is turned so as to shift the sheet-like-shaped member 23 to a suitable one of the predetermined vertical positions.

As described above, the nip width is adjusted by the turn of the eccentric roller 31 to change the vertical position of the sheep-like-shaped member 23. However, the adjustment of the nip width is not so limited. For example, a different stopper may be provided at the free edge side of the sheet-like-shaped member 23, configured to be slidable in vertical and horizontal directions. With such a structure, the nip width can be adjusted by a movement of the stopper.

In addition, since the sheet-like-shaped member 23 has a part which contacts with and is rubbed by the rotating fixing roller 21 in the nip area, such part may be prone to be worn and/or deformed. However, the wearing and/or deformation of the sheet-like-shaped member 23 may be reduced by the configuration in which the sheet-like-shaped member 23 can be separated from the fixing roller 21 with the actuator 29.

Further, the first stopper 28 is provided under the sheet-like-shaped member 23 with a slight gap from the rear surface of the sheet-like-shaped member 23. With this gap, it becomes possible to avoid deformation of the sheet-like-shaped member 23 in the nip area, which may be caused when the recording sheet is jammed while passing between the fixing roller 21 and the sheet-like-shaped member 23.

In addition, when a sheet jam occurs in the nip area, the jammed-sheet may easily be removed from the nip area after the fixing roller 21 is separated from the sheet-like-shaped member 23 with the actuator 29. To separate the fixing roller 21 and the sheet-like-shaped member 23 from each other, it is also possible to move the sheet-like-shaped member 23. In this case, however, the second stopper 30 is required to be moved away.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent application No. JPAP2001-188059 filed on Jun. 21, 2001 in the Japanese Patent Office, the entire contents of which are incorporated by reference herein.

What is claimed is:

1. An image fixing apparatus, comprising:

a fixing roller including a heater and configured to rotate to forward a recording sheet having a toner image;

a sheet-like-shaped member configured to contact said fixing roller to form a nip area with said fixing roller;

a sheet supporter configured to support said sheet-like-shape member at an upstream side of a bottom surface of said sheet-like-shaped member in a direction in which said sheet-like-shaped member in a direction in which said recording sheet is transferred;

a stopper configured to stop a free side of said sheet-like-shaped member so that said free side of said sheet-like-shaped member is not lower than a predetermined position; and a pressure member urging at least one of the fixing roller and the sheet-like-shaped member toward the other.

2. An image fixing apparatus as defined in claim 1, wherein said stopper is configured to be movable, and said image fixing apparatus further compromises an adjustment mechanism configured to move said stopper to adjust a vertical position of said sheet-like-shaped member.

3. An image fixing apparatus as defined in claim 2 wherein said stopper is configured to be an eccentric roller having an eccentric shaft and said adjustment mechanism includes a shaft supporter for supporting said eccentric shaft and an adjuster for turning said eccentric shaft.

4. An image fixing apparatus as defined in claim 3, wherein said eccentric shaft is configured to have a cross section of a polygonal and said shaft supporter is configured to have a V-like-shaped portion to be engaged with a corner of the polygon of the eccentric shaft.

5. An image fixing apparatus as defined in claim 3, wherein said adjuster is connected to said eccentric shaft is configured to have indexes for indicating information associated with turning positions of said eccentric shaft corresponding to vertical positions of said sheet-like-shaped members.

6. An image fixing apparatus as defined in claim 5, wherein said information indicated by said indexes includes applicable thickness of a recording sheet corresponding to said vertical positions of said sheet-like-shaped member.

7. An image fixing apparatus as defined in claim 1, further comprising:

a moving mechanism configured to move said fixing roller to make contact with said sheet-like-shaped member.

8. An image fixing apparatus as defined in claim 7, wherein said moving mechanism comprises:

a holding member configured to hold said fixing roller for rotation; and a pressing member configured to apply a force to said holding member in a direction toward said sheet-like-shaped member.

9. An image fixing apparatus as defined in claim 8, wherein said holding member is provided with a turning shaft at a position different from rotation axis of said fixing roller so that said holding member is caused to pivot about said turning shaft by said force of said pressing member to make contact with said sheet-like-shaped member.

10. An image fixing apparatus as defined in claim 9, wherein said moving mechanism further comprises:

an actuating lever configured to switch to a first position to hold said holding member against said force of said pressing member such that said fixing roller is separated from said sheet-like-shaped member and to a second position to release said holding member so that said fixing roller contacts said sheet-like-shaped member; and a stopper provided to said holding member for selectively stopping said actuating lever at said first position.

11. An image fixing apparatus as defined in claim 1, wherein said sheet-like-shaped member is made of a rigid and heat-resistant resin.

12. An image fixing apparatus, comprising:

a plurality of rollers including at least one fixing roller containing a heat source;

a sheet-like-shaped member which contacts said fixing roller and form a nip area therewith and which is made of a rigid and heat-resistant resin;

a holder configured to hold one side of said sheet-like-shaped member; and a stopper configured to stop a free side of said sheet-like-shaped member such that said free side of said sheet-like-shaped member is not lowered below a predetermined position.

13. An image fixing apparatus, comprising:

fixing roller means for applying heat and pressure to a recording sheet having a toner image and simultaneously forwarding said recording sheet in a sheet transfer direction;

sheet-like-shaped member means for forming a nip area together with said fixing roller;

sheet supporting means for supporting said sheet-like-shaped member means at an upstream side of a bottom surface of said sheet-like-shaped member means in said sheet transfer direction;

stopping means for stopping a free side of said sheet-like-shaped member means so that said free side of said sheet-like-shaped member means is not lowered below a predetermined position; and a pressure member urging at least one of the fixing roller and the sheet-like-shaped member toward the other.

14. An image fixing apparatus a defined in claim 13, wherein said stopping means is movable, and said image fixing apparatus further comprises adjusting means for moving said stopping means to adjust a vertical position of said sheet-like-shaped member means.

15. An image fixing apparatus as defined in claim 14, wherein said stopping means includes an eccentric roller having an eccentric shaft and said adjusting means includes a shaft supporter for supporting said eccentric shaft and an adjuster for turning said eccentric shaft.

16. An image fixing apparatus as defined in claim 15, wherein said eccentric shaft is configured to have a cross section of a polygonal and said shaft supporter is configured to have a V-like-shaped portion to be engaged with a corner of the polygon of the eccentric shaft.

17. An image fixing apparatus as defined in claim 15, wherein said adjuster is connected to said eccentric shaft and is configured to have indexes for indicating information associated with turning positions of said eccentric shaft corresponding to vertical positions of said sheet-like-shaped member means.

18. An image fixing apparatus as defined in claim 17, wherein said information indicated by said indexes includes applicable thickness of a recording sheet corresponding to said vertical positions of said sheet-like-shaped member means.

19. An image fixing apparatus as defined in claim 13, further comprising:

moving means for moving said fixing roller means to make contact with said sheet-like-shaped member means.

20. An image forming apparatus as defined in claim 19, wherein said moving means comprises:

holding means for holdings said fixing roller means for rotation; and pressing means for apply a force to said holding means in a direction toward said sheet-like-shaped member means.

21. An image fixing apparatus as defined in claim 20, wherein said holding means is provided with a turning shaft at a position different from a rotation axis of said fixing roller means so that said holding means is caused to pivot about said turning shaft by said force of said pressing means to make contact with said sheet-like-shaped member means.

22. An image fixing apparatus as defined in claim 21, wherein said moving means further comprises:

actuating means for switching to a first position to hold said holding means against said force of said pressing means such that said fixing roller means is separated from said sheet-like-shaped member means and to a second position to release said holding means so that said fixing roller means is made in contact with said sheet-like-shaped member means;

a stopper provided to said holding means for selectively stopping said actuating means at said first position; and a pressure member urging at least one of the fixing roller and the sheet-like-shaped member toward the other.

23. An image fixing apparatus as defined in claim 13, wherein said sheet-like-shaped member means is made of a rigid and heat-resistant resin.

24. An image fixing apparatus, comprising:

plurality of roller means including at least one fixing roller containing a heating source;

sheet-like-shaped member means for contracting said fixing roller and forming a nip area therewith and which is made of a rigid and heat-resistant resin;

holding means for holding one side of said sheet-like-shaped member means; and stopping means for stopping a free side of said sheet-like-shaped member means such that said free side of said sheet-like-shaped member means is not lowered below a predetermined position.

25. An image fixing apparatus, comprising:

a fixing member made of a flexible material, having a cylindrical cross section and configured to rotate to forward a recording sheet having a toner image thereon in a sheet transfer direction;

a driving mechanism for selectively moving said fixing member;

a heating source at an internal side of said fixing member;

a sheet-like-shaped member configured to be heated by said heating source via said fixing roller and to form a nip area with said fixing roller;

a sheet supporter configured to support said sheet-like-shaped member in an upstream side of a bottom surface of said sheet-like-shaped member in said sheet transfer direction; and a stopper configured to stop a free side of said sheet-like-shaped member so that said free side of said sheet-like-shaped member is not lowered below a predetermined position; and a pressure member urging at least one of the fixing roller and the sheet-like-shaped member toward the other.

26. A method of image fixing, comprising the steps of:

providing a fixing roller which includes a heater and is rotated to forward a recording sheet having a toner image in a sheet transfer direction;

arranging a sheet-like-shaped member made of a rigid and heat-resistant material under said fixing roller;

supporting said sheet-like-shaped member at an upstream side of a bottom surface of said sheet-like-shaped member in said sheet transfer direction;

applying a pressure to said fixing roller so that said fixing roller contacts under pressure with said sheet-like-shaped member to form a nip area there between;

stopping a free side of said sheet-like-shaped member so that said free side of said sheet-like-shaped member is not lowered below a predetermined position; and transferring a recording sheet having a toner image thereon into said nip area in said sheet transfer direction.

27. An image forming apparatus, comprising:

an image fixing apparatus, comprising:

a fixing roller including a heater and configured to rotate to forward a recording sheet having a toner image;

a sheet-like-shaped member configured to contact said fixing roller to forma nip area with said fixing roller;

a sheet supporter configured to support said sheet-like-shaped member at an upstream side of a bottom surface of said sheet-like-shaped member in a direction in which said recording sheet is transferred;

a stopper configured to stop a free side of said sheet-like-shaped member so that said free side of said sheet-like-shaped member so that said free side of said sheet-like-shaped member is not lowered below a predetermined position; and a pressure member urging at least one of the fixing roller and the sheet-like-shaped member toward the other.

28. Apparatus comprising:

a heated fixing roller and resilient, sheet-like-shaped members electively pressing against each other to form a nip area;

said fixing roller selectively rotating to move, in a forward direction, a sheet with a toner image thereon fed said nip area in said forward direction;

said member having an upstream portion and a downstream portion relative to said nip and said forward direction;

a first support engaging said member at said upstream portion to limit motion of the upstream portion away from the fixing roller; and a second support selectively engaging said downstream position to limit motion of the downstream portion away form the fixing roller;

whereby said sheet is subjected to heat and pressure in passing through said nip area to fix said toner image.

29. Apparatus as in claim 28 in which at least one of said supports has a plurality of positions each corresponding to a different degree of pressure at said nip.

30. Apparatus as in claim 29 wherein only said second support has said plurality of positions, and its distance from said fixing roller is different for each of said positions.

31. Apparatus as in claim 30 including a mount supporting at least one of the fixing roller and the member for motion between a working position in which the roller and member press against each other and a rest position in which they are out of pressure with each other.

32. A method comprising:

forming a nip between a heated fixing roller and a resilient, sheet-like-shaped member selectively pressing against each other;

supporting a portion of said member that is upstream of said nip relative to a forward direction, and a portion of said member that is downstream from said nip relative to said forward direction;

said supporting comprising selectively changing the pressure at said nip; and passing a sheet with a toner image thereon in said forward direction through said nip to hereby fix the toner image.

33. A method as in claim 32 in which said supporting comprises selectively limiting motion of said downstream portion of the member from roller under operator control.

34. A method as in claim 32 including selectively moving at least one of the fixing roller and the member between a working position in which they press against each other and rest position in which they are out of pressure with each other.

* * * * *